US011672728B1

(12) United States Patent
Williams et al.

(10) Patent No.: US 11,672,728 B1
(45) Date of Patent: Jun. 13, 2023

(54) SELECTABLE, CONFIGURABLE AND INTERCHANGEABLE MASSAGE TOOL HEAD SYSTEM FOR PERCUSSION MASSAGE DEVICES

(71) Applicant: PlayMakar Inc., Fort Worth, TX (US)

(72) Inventors: Michael James Williams, Colleyville, TX (US); Federico G. Vierheller, Fort Worth, TX (US); Wesley A. Coleman, N. Richland Hills, TX (US)

(73) Assignee: PlayMakar Inc., Fort Worth, TX (US)

( * ) Notice: Subject to any disclaimer, the term of this patent is extended or adjusted under 35 U.S.C. 154(b) by 0 days.

(21) Appl. No.: 17/714,140

(22) Filed: Apr. 5, 2022

(51) Int. Cl.
*A61H 23/00* (2006.01)

(52) U.S. Cl.
CPC ..... *A61H 23/006* (2013.01); *A61H 2023/002* (2013.01); *A61H 2201/0103* (2013.01); *A61H 2201/1246* (2013.01); *A61H 2201/1688* (2013.01); *A61H 2201/1695* (2013.01)

(58) Field of Classification Search
CPC .... A61H 23/00; A61H 23/004; A61H 23/006; A61H 23/04; A61H 23/06; A61H 2023/002; A61H 2201/0103; A61H 2201/1246; A61H 2201/1688; A61H 2201/1695; A61H 9/005
See application file for complete search history.

(56) References Cited

U.S. PATENT DOCUMENTS

| | | | |
|---|---|---|---|
| 859,424 | A | 7/1907 | Aschburner |
| 890,822 | A | 6/1908 | Tourtel et al. |
| 1,368,782 | A | 2/1921 | Beach |
| 2,122,556 | A | 7/1938 | Buffalow |
| 2,156,839 | A | 5/1939 | Buffalow |
| 4,088,128 | A | 5/1978 | Mabuchi |
| 4,513,737 | A | 4/1985 | Mabuchi |
| 4,549,535 | A | 10/1985 | Wing |
| D284,553 | S | 7/1986 | Collister |
| 4,726,430 | A | 2/1988 | Hendrikx et al. |
| 4,790,296 | A | 12/1988 | Segal |
| 4,841,955 | A | 6/1989 | Evans et al. |
| 5,085,207 | A | 2/1992 | Fiore |
| 5,134,777 | A | 8/1992 | Meyer |

(Continued)

FOREIGN PATENT DOCUMENTS

| | | | |
|---|---|---|---|
| CH | 388531 | A | 2/1965 |
| CN | 205268525 | U | 6/1916 |

(Continued)

OTHER PUBLICATIONS

English translation for CH388531, espacenet.com, translated on Jul. 8, 2021.

(Continued)

*Primary Examiner* — Colin W Stuart
*Assistant Examiner* — Matthew D Ziegler
(74) *Attorney, Agent, or Firm* — Dawn-Marie Bey; Bey & Cotropia PLLC

(57) ABSTRACT

A selectable impact tip system for use with a percussion massager includes multiple flexible and interchangeable massage tips having variable internal geometries. The variable internal geometries of the flexible and interchangeable tips cause different impact forces during use when used with the reciprocating piston and the removable and hollow shaft of the percussion massager.

9 Claims, 22 Drawing Sheets

(56) References Cited

U.S. PATENT DOCUMENTS

D373,571 S 9/1996 Zambelli
5,656,017 A 8/1997 Keller et al.
5,690,608 A 11/1997 Watanabe et al.
6,228,042 B1 5/2001 Dungan
6,357,125 B1 3/2002 Feldmann et al.
6,616,621 B1 9/2003 Kohr
6,682,496 B1 1/2004 Pivaroff
6,758,826 B2 7/2004 Luettgen et al.
D525,115 S 7/2006 Harwanko
7,122,013 B2 * 10/2006 Liu ..... A61H 5/00 601/13
7,144,417 B2 12/2006 Colloca et al.
D544,102 S 6/2007 Pivaroff
D578,080 S 10/2008 Whang
7,503,923 B2 3/2009 Miller
D607,852 S 1/2010 Riede
D632,265 S 2/2011 Choi
D639,784 S 6/2011 Murayama
D649,657 S 11/2011 Petersen et al.
8,083,699 B2 12/2011 Colloca et al.
D662,398 S 6/2012 Jahnke
D679,576 S 4/2013 Paul
8,826,547 B2 9/2014 Oberheim
8,968,221 B2 * 3/2015 Pryor ..... A61N 5/0613 601/19
D738,355 S 9/2015 Smith
D751,538 S 3/2016 Koehler
D756,333 S 5/2016 Smith
9,526,671 B2 * 12/2016 Week ..... A63B 21/0004
D781,674 S 3/2017 Bullard
9,889,066 B2 2/2018 Danby et al.
D826,205 S 8/2018 Langhammer
D837,395 S 1/2019 Gan
D840,355 S 2/2019 Simon
D848,398 S 5/2019 Huang
D849,260 S 5/2019 Wersland
D850,639 S 6/2019 Wersland
D850,640 S 6/2019 Wersland
10,314,762 B1 6/2019 Marton et al.
10,357,425 B2 7/2019 Wersland et al.
D855,822 S 8/2019 Marton
D857,650 S 8/2019 Hardi
D859,680 S 9/2019 Wersland
D867,342 S 11/2019 Afshar Bakooshli
10,485,731 B2 * 11/2019 Babiuk ..... A61H 23/006
10,492,984 B2 12/2019 Marton et al.
D873,432 S 1/2020 Duan
D874,015 S 1/2020 Marton
10,561,574 B1 2/2020 Marton et al.
D886,317 S 6/2020 Marton
D890,353 S 7/2020 Nazarian
D890,942 S 7/2020 Wersland
D890,943 S 7/2020 Wersland
10,702,448 B2 7/2020 Wersland et al.
D893,738 S 8/2020 Zhuang
D895,133 S 9/2020 Xu
D895,135 S 9/2020 Xu
D895,402 S 9/2020 Hung
D895,828 S 9/2020 Marshall
D895,831 S 9/2020 Chen
D896,393 S 9/2020 Wersland
D898,933 S 10/2020 Xu
D905,863 S 12/2020 Lin
D906,533 S 12/2020 Xu
D907,792 S 1/2021 Marton et al.
D908,235 S 1/2021 Marton et al.
D910,870 S 2/2021 Marton
D917,060 S 4/2021 Hu
D918,404 S 5/2021 Wersland
D918,405 S 5/2021 Wersland
D918,408 S 5/2021 Huang
10,993,874 B1 5/2021 Marton et al.
D920,944 S 6/2021 Paterson
D924,422 S 7/2021 Huang
D927,716 S 8/2021 Wersland
D927,717 S 8/2021 Wersland
D931,492 S 9/2021 Li
D935,403 S 11/2021 Wu
D935,404 S 11/2021 Wu
D938,056 S 12/2021 Wu
D940,892 S 1/2022 Shen
D941,145 S 1/2022 Wang
11,253,423 B1 2/2022 Williams
D949,365 S 4/2022 Li
D949,366 S 4/2022 Li
D949,384 S 4/2022 Liang
D949,417 S 4/2022 Khubani
D949,418 S 4/2022 Khubani
D952,878 S 5/2022 Lin
D958,654 S 7/2022 Lupberger
D959,268 S 8/2022 Hume
D961,107 S 8/2022 Tian
D961,795 S 8/2022 Zhao
D967,971 S 10/2022 Jinfeng
11,478,400 B1 10/2022 Marton
2002/0082532 A1 6/2002 Tucek et al.
2002/0107459 A1 8/2002 Chang
2003/0009116 A1 1/2003 Luettgen et al.
2003/0009118 A1 1/2003 Sabo
2003/0028134 A1 2/2003 Lev
2003/0040689 A1 2/2003 Chan et al.
2003/0101847 A1 6/2003 Harimoto
2003/0195443 A1 10/2003 Miller
2005/0109137 A1 5/2005 Hartmann
2005/0113870 A1 5/2005 Miller
2005/0131461 A1 6/2005 Tucek et al.
2006/0025710 A1 * 2/2006 Schulz ..... A61H 23/008 601/75
2006/0293711 A1 12/2006 Keller et al.
2008/0014011 A1 1/2008 Rossen
2008/0183252 A1 7/2008 Khen
2009/0270915 A1 10/2009 Tsai et al.
2010/0137907 A1 6/2010 Tsai
2014/0031866 A1 1/2014 Fuhr et al.
2015/0005682 A1 1/2015 Danby et al.
2015/0107383 A1 4/2015 Duesselberg et al.
2015/0182415 A1 7/2015 Olkowski et al.
2016/0354277 A1 12/2016 Fima
2016/0367425 A1 12/2016 Wersland
2017/0304145 A1 10/2017 Pepe
2018/0008512 A1 1/2018 Goldstein
2018/0168913 A1 6/2018 Sedic
2018/0200141 A1 7/2018 Wersland et al.
2018/0263845 A1 9/2018 Wersland et al.
2018/0320732 A1 11/2018 Kim
2018/0353369 A1 12/2018 Newns et al.
2019/0015294 A1 1/2019 Nazarian et al.
2019/0175434 A1 6/2019 Zhang
2019/0209424 A1 7/2019 Wersland et al.
2019/0232403 A1 8/2019 Candelaria
2019/0254921 A1 8/2019 Marton et al.
2019/0350793 A1 11/2019 Wersland et al.
2020/0046604 A1 2/2020 Danby et al.
2020/0085675 A1 3/2020 Lee et al.
2020/0110526 A1 4/2020 Ano et al.
2020/0170871 A1 6/2020 Lukinuk et al.
2020/0214930 A1 7/2020 Wersland et al.
2020/0261307 A1 8/2020 Wersland et al.
2020/0261310 A1 8/2020 Wersland et al.
2020/0268594 A1 8/2020 Pepe
2020/0276079 A1 9/2020 Cheng
2020/0289365 A1 9/2020 Wersland et al.
2020/0330321 A1 10/2020 Wersland et al.
2020/0352820 A1 11/2020 Nazarian et al.
2020/0352821 A1 11/2020 Wersland et al.
2020/0390644 A1 12/2020 Yang
2020/0393026 A1 12/2020 Chang
2020/0405574 A1 12/2020 Wersland et al.
2021/0003168 A1 1/2021 Cong
2021/0022951 A1 1/2021 Hu
2021/0022955 A1 1/2021 Wersland
2021/0059898 A1 3/2021 Wersland et al.
2021/0113421 A1 4/2021 Chuang
2021/0128402 A1 5/2021 Dai et al.

(56) References Cited

U.S. PATENT DOCUMENTS

| | | | | |
|---|---|---|---|---|
| 2021/0137779 | A1 | 5/2021 | Ayu et al. | |
| 2021/0196562 | A1 | 7/2021 | Zhao | |
| 2021/0244610 | A1 | 8/2021 | Wersland et al. | |
| 2021/0322257 | A1 | 10/2021 | Lee et al. | |
| 2021/0369549 | A1* | 12/2021 | Almodovar | A61H 7/003 |
| 2022/0096320 | A1 | 3/2022 | Lu | |
| 2022/0154764 | A1 | 5/2022 | Yamashita | |
| 2022/0168175 | A1 | 6/2022 | Tang | |
| 2022/0168177 | A1 | 6/2022 | Vierheller | |
| 2022/0211575 | A1 | 7/2022 | Wersland | |

FOREIGN PATENT DOCUMENTS

| | | | |
|---|---|---|---|
| CN | 206381369 | U | 8/1917 |
| CN | 208130157 | U | 11/1918 |
| CN | 2694966 | Y | 4/2005 |
| CN | 202536467 | U | 11/2012 |
| CN | 306178047 | | 11/2020 |
| CN | 212749648 | U | 3/2021 |
| CN | 2020305792978 | | 3/2021 |
| CN | 2021302494257 | | 8/2021 |
| KR | 102249761 | B1 | 5/2021 |
| TW | M543692 | U | 6/1917 |
| TW | M511855 | U | 11/2015 |
| TW | D207405 | | 9/2020 |
| WO | WO 2022/149067 | | 7/2022 |

OTHER PUBLICATIONS

Youtube,, "ShoDuo Absorption & Reverberation Massage Head", Published Date: Sep. 26, 2022. https://www.youtube.com/ watch?v=OW6z6eYNo4o (Year: 2022).

amazon.com; Massage Gun Massage Gun—Massage Pulse Mini Muscle Massage Gun; Apr. 28, 2022; 2 pgs.

AliExpress.com; Portable Massage Gun Deep Tissue Percussion Muscle Massager for Pain; retrieved on Nov. 22, 2022; 1 pg.

amazon.com; Mebak 3 Massage Gun Muscle Massager Electric Hand Massager, May 22, 2020; 3 pgs.

Flyby—Massage gun. Date: Aug. 11, 2020. [online]. [Site visited Dec. 1, 2022]. Available from Internet URL: www.youtube.com/ watch?v =GYvuNuif8Bc (Year: 2020).

Massage guns. (Design—© Questel) orbit.com. [Online PDF compilation of references selected by examiner] 50 pgs. Print Dates Range Apr. 28, 2020-Mar. 11, 2022 [Retrieved Dec. 2, 2022] https://www.orbit.com/export/UCZAH96B/pdf4/e6b9a3b3-195c-4fbe-87b2- 0eaaf315609e-165234.pdf (Year: 2022).

HP Race Development—Titanium connecting rods. Date: Apr. 30, 2021. [online]. [Site visited Dec. 15, 2022]. Available from Intemet URL: https://www.hpracedevelopment.com/news/titanium-connecting-rods-now-available-all-current-250f-models#/ (Year: 2021).

English translation for CN 212749648 from Espacenet on Jul. 18, 2022 (year 2021).

Massage Gun Deep Tissue, Percussion Muscle Massager Gun for Atnletes—Flyby F1 Pro—Handheld Neck & Back Massager for Pain Relief—Therapy and Relaxation Body Massager Gun—Lightweight (Black), [retrieved on Oct. 28, 2021], 9 pp., Retrieved from the Internet: https://www.amazon.com/massage-Gun-Deep-Tissue-Lightweight/dp/B07Y8SRYL3/ref=sr_1_1_sspa?crid=2WYI8SO0AT230&dchild=1&keywords=flyby%2Bmassage%2Bgun&qid=1635265651&s=hpc&sprefix=Flyby%2B%2Chpc%2C179&sr=1-1-.

Toloco Massage Gun, upgrade Percussion Muscle Massage Gun tor Athletes, Handheld Deep Tissue Massager Black), [retrieved on Oct. 29, 2021], 10 pp., Retrieved from the Internet: https://www.amazon.com/TOLOCO-massage-Gun-Upgraded-Brushless/dp/B083L8RNJR/ref=sr_1_1 sspa?dchild=1&keywords=Massage%2Bgun&qid=1635272886&sr=8-1 -spons&spLa=ZW5jcnlwdGVkUXVhbGImaWVyPUFETDEwSENOVDg4SzgmZW5jcnlwdGVkSWQ9QTAyOTUzNTMxN.

Massage Gun Deep Tissue, Muscle Percussion Back Neck Head Handheld Hammer Massager for Athletes, 30 speed Level, LED Touch Screen, Long Battery Life with 10 Heads, [retrieved on Oct. 29, 2021], 9 pp., Retrieved from the Internet: https://www.amazon.com/Massage-Percussion-Handheld-massager-Athletes/dp/B08QJNVP6F/ref=sr_1_4_sspa?dchild=1&keywords=Massage+gun&qid=1635272918&sr=8-4-spons&psc=1&spLa=ZW5jcnlwdGVkUXVhbGImaWVyPUFKT1dTTDBISUU5TEsmZW5jcnlwdGVkSWQ9QTA3MTI5MN.

English translation for KR 102249761, translated by espacenet.com, translated on Oct. 31, 2022.

* cited by examiner

FULL STROKE

CONTACT STATE

NORMAL STATE

SECTION B-B

SELECTABLE, CONFIGURABLE AND INTERCHANGEABLE MASSAGE TOOL HEAD SYSTEM FOR PERCUSSION MASSAGE DEVICES

BACKGROUND

Technical Field

The embodiments herein are generally directed to tips used with percussion massage tools and more specifically to tips and tool designs which enable customization of a massage experience by controlling impact force.

Description of Related Art

Massage devices are known in the art and present uses include, but are not limited to, pre-work out warm-up or post-activity recovery to increase range of motion and flexibility when administered before sports activity and muscle pliability where massage techniques are applied with a thumb, palm and elbow, used to reduce stress, increase relaxation, reduce pain and muscle soreness and tension. Improving circulation, energy and alertness. Massage devices have also been known to help prevent sore muscles after exercise known as "delayed onset muscle soreness or DOMS. Such massage devices are used in, for example, athletic, physiotherapeutic and chiropractic environments and to a much larger extent now in the home environment. Current tool heads, including massage tips, for percussion massage devices are somewhat inflexible in their design and rely on the body tissue to act as the primary shock absorber. Current tool head tips are composed of hard plastic or closed cell foam and do not offer users various measured tool heads based on impact and do not take into account the users body, needs and use application.

Further, prior art designs may be causing damage to the fascia, i.e., a thin casing of connective tissue that surrounds and holds every organ, blood vessel, bone, nerve fiber and muscle in place. When hammering into this area with a high intensity motor, blood vessels can rupture, creating inflammation, and ultimately cause bruising. This counter to the goal of massage therapy, which is to increase blood flow that transports beneficial oxygen and nutrients to our muscles. When we shatter these pathways, we counteract the potential gains.

Accordingly, there is a need in the art for tip and/or tool designs that allow a user to customize the impact based on comfort, body part impacted, medical needs.

SUMMARY OF THE EMBODIMENTS

A selectable impact tip system for percussion massagers that allows users to select and interchange tips based on user preference and targeted customization for comfort, muscle density, muscle soreness, body part and clinical application.

To impose greater mechanical control on applied force and impact control on percussion massage tool head impact the embodiments exemplified herein use various mechanical absorption and reverberation methods including fixed and non-fixed methods such as springs, pneumatics, tip design and elastomeric durometer scales. Greater control of reverberation, spring back and absorption is achieved through one or more of the following:

Tool heads may use various compression force values.

Tips may use a pneumatic bladder that may be inflated or deflated. Pneumatic tips may have valve on outside and/or from within the shaft to control inflation/deflation.

Tip material durometer and density may be changed to reduce/increase impact forces as desired.

Tip design that features air transfer capability and air visibility chamber. Tip is a mechanical damper device designed to absorb and damp shock impulses created for the percussion massager device. It does this by converting the kinetic energy of the shock into another form of energy which is then dissipated by the geometrical shape of the attachment by having an air chamber that allows the tip of the attachment to flex in a controlled distance, represented by the "air chamber."

Tip shafts may use fixed shafts, with adjustability to reduce the gap between tip head and "bottom out" point. This distance becomes variable when adjusted with a device (screw) that attaches firmly to the shaft of the attachment and having the property of modifying the space of the "air chamber", changing as a result the shock dampening properties of the flexible tip.

Tips maybe visibly coded to give users can easily identifiable way and progressive system to quickly locate appropriate tip for use in applications.

Example embodiments in general relate to an attachment system for a percussive massager device, wherein users may select the attachment heads in a percussive massager device based on the desired impact energy of the collision force. A color coding, alphanumeric coding, graphics coding or other visual indication system may be implemented to provide a user with an indication of the level of impact that is to be expected for each massage tip in a set.

One object of the embodiments is to provide tool head attachments primarily designed to be used in massage instruments which include shock attenuation and impact absorbing functions.

One object is to provide an attachment system for a percussive massager device to facilitate user selection of a specific attachment based on the impact energy of the collision force as indicated through a coding system.

Other objects and advantages of the various embodiments of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

In a first embodiment herein, a percussion massager attachment tool includes: an enclosure including a reciprocating piston and a hollow shaft; a first flexible tip having an outer dome shape securely connected to a first end of the enclosure, wherein when secured to the first end of the enclosure, a first inner geometry of the flexible tip forms an air gap having a first height, $H_1$, between an inside of the flexible tip and the first end of the enclosure when the reciprocating piston is in a first state of operation; and further wherein when the reciprocating piston is in a second state of operation the air gap has a second height, $H_2$, where $H_2<H_1$ and air is transferred from the air gap through the hollow shaft and is discharged from the percussion massager attachment tool via one or more channels in the shaft capable of discharging air at a second end of the enclosure, the percussion massager attachment tool with the first flexible tip providing a first impact force range.

In a second embodiment herein, a percussion massager attachment tool includes: an enclosure including a reciprocating piston, a shaft, at least one adjustable spring and at least one adjustment means for compressing and decompressing coils of the at least one adjustable spring; a first flexible tip connected to a first end of the enclosure, wherein when the at least one adjustable spring is in a first configuration, the percussion massager attachment tool with the first flexible tip provides a first impact force range and when the at least one adjustable spring is in a second configuration, the percussion massager attachment tool with the first flexible tip provides a second impact force range.

In a third embodiment herein, a percussion massager attachment tool includes: an enclosure including a reciprocating piston and a shaft; a first inflatable tip secured to a first end of the enclosure, means for inflating the first inflatable tip and means for deflating the first inflatable tip, wherein when the first inflatable tip is inflatable to a first level, the percussion massager attachment tool provides a first impact force range and when the first inflatable tip is inflatable to a second level, the percussion massager attachment tool provides a second impact force range.

In a fourth embodiment herein, a percussion massage attachment tool includes: an enclosure including a reciprocating piston and a hollow shaft; a first flexible tip securely connected to a first end of the enclosure, wherein when secured to the first end of the enclosure, the flexible tip forms an air gap having height H between an inner wall of the flexible tip and the first end of the enclosure when the reciprocating piston is in a first state of operation; and further comprising an adjustable screw passing through the hollow shaft, wherein a user can vary a space S between an end of the screw the inner wall of the first flexible tip by turning the screw, wherein S can be adjusted from $0 \leq S \leq H$.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1A:
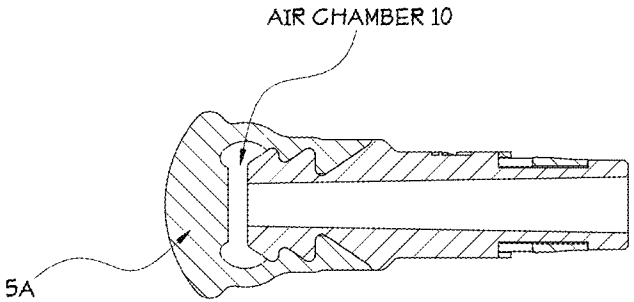
FIGS. 1*a* and 1*b* illustrate a first low impact tool configuration in accordance with a first embodiment described herein.

A dynamic response analysis in an elastic collision teaches us that objects involved remain separate, where the total kinetic energy and momentum are conserved. This means that the colliding objects bounce off one another with no energy loss as a result of the collision. In the case of percussion massage tips, the interaction with the body is a "nearly elastic collision" because some kinetic energy is lost in heat, sound, and internal energy allowing the body tissue to wave as a result. In the present embodiments, total momentum is conserved and the total kinetic energy is not conserved. The collision is considered to be elastic because the tip, which is deformed during collision, and the body tissue, also deformed during collision, both return to their original state after the collision. Also relevant is the concept of shock loading which refers to a sudden and drastic increase of load similar to a hammering effect. The net force is equal to the derivative of momentum as a function of time defining impact as a change in momentum, represented by the change in the response velocity of the tool head tip of the absorbing device and human tissue.

The typical percussion massager attachment tip uses one or more materials or components which affect the force of impact in two important ways, i.e. through shock absorption and energy absorption. Shock absorption involves the attenuation of harmful impact forces. A percussion massager attachment tip with high shock absorbing and reverberation characteristics thus can provide a more beneficial massager therapy experience, assuming other mechanical aspects are not compromised. Absorption of energy may be considered the general soaking up of both impact and useful propulsive forces. Thus, a percussion massager attachment tip with high energy absorbing and reverberation characteristics has relatively lower resiliency, which generally does not return as much of the energy placed into the tip at soft tissue impact.

Furthermore, high absorbing and reverberation tips can also produce a continuation or extended massage stroke length creating a secondary impact. This results in a continuing effect or repercussion. Conversely, a percussion massage tip with low energy absorbing characteristics has relatively higher resiliency, and generally returns more of the energy placed into a tip at soft tissue impact.

Rubber or elastomeric materials are widely used for shock absorbers having elastic and viscous properties such as high inherent damping, deflection capacity, and energy storage. By definition damping properties of rubber is fulfilled for a system with kinematic excitation based on two approaches: using Maxwell and Burgers mechanical models combining of elastic and viscous elements and using Rabotnov's kernel of relaxation for analytical representation of visco-elastic properties of rubber.

The following embodiments illustrate just a few of the different ways that a user can customize their percussion massage experience by either selecting a specific predetermined tip design with set force expectation and/or adjusting force using one or more customization controls available with the tool tip.

A. Low Level Impact

In a first embodiment, an exemplary tool head for use with a percussion massager is intended to provide a user with the lowest impact level experience, or levels, as compared to other tool head configurations in a set of tool heads. Impact level can vary based on a number of factors including tool configuration, tip shape (external and internal) and material, as well as user selectable changes to the tool configuration as will be discussed herein. Use of the terms low, medium and high herein are relative.

Figure 1B:
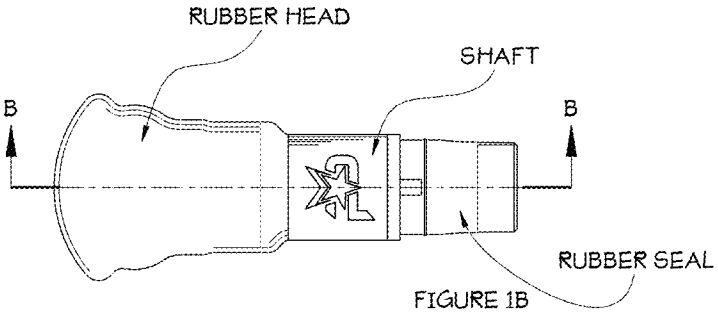

A first low impact tool configuration is represented by a tool configuration which includes a tip shape as shown in FIGS. 1*a* and 1*b* and which includes an air chamber or gap 10 as shown in FIG. 1*a*. The tip 5A material is formed of a rubber material having a predetermined durometer value, such as 60, on the Shore A durometer scale. The air chamber may be for example, on the order of 0-10 mm. In one particular embodiment, wherein the tip includes a transparent portion, wherein the air chamber is visible during use of the percussion massage attachment tool. In an exemplary configuration, a 5 mm tip deformation results from an impact force of approximately 6.52 Joules.

Figures 1C, 1D, 1E:
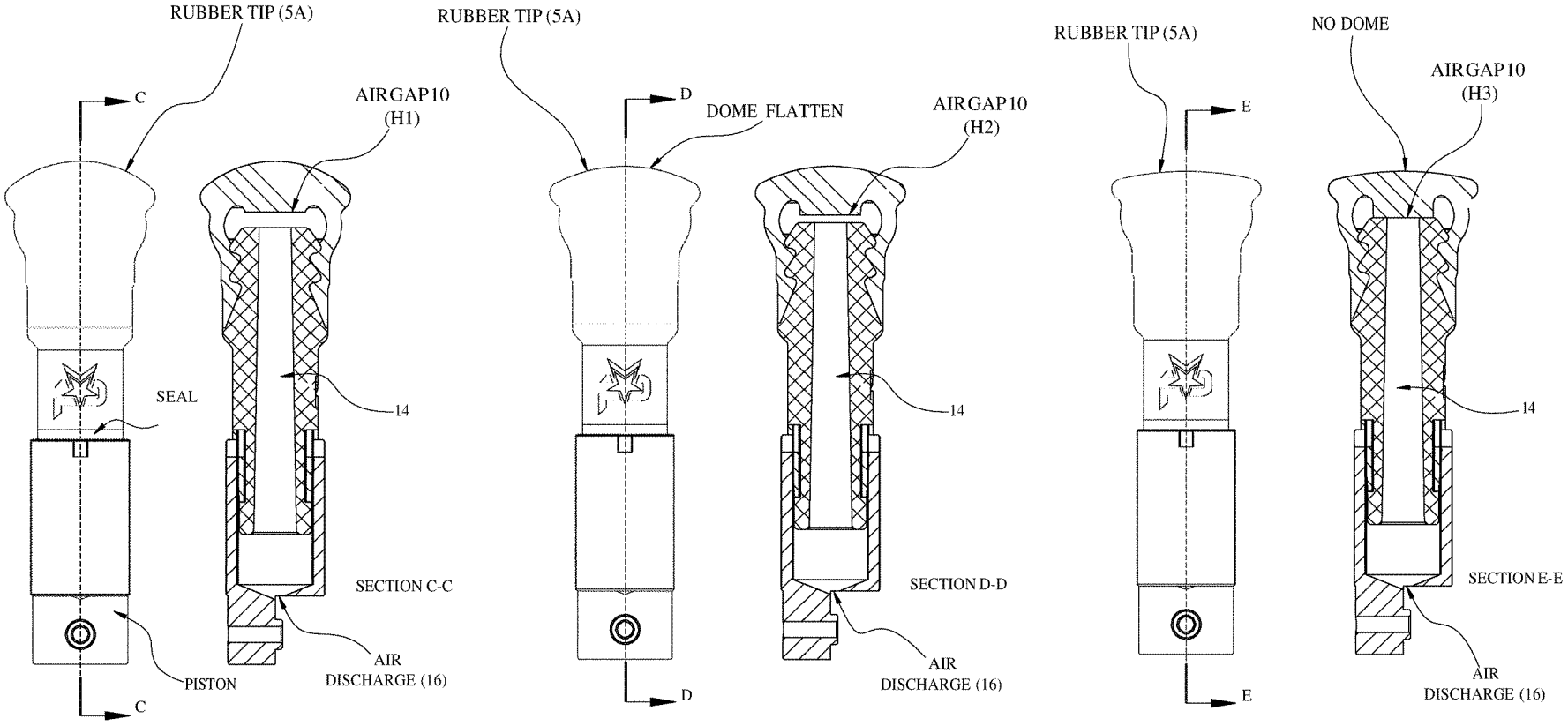
FIGS. 1*c*, 1*d* and 1*e* illustrate impact stages of the tip and tissue for the tool configuration of FIGS. 1*a* and 1*b* in accordance with a first embodiment described herein.

FIGS. 1*c*, 1*d*, 1*e* show a second exemplary massage tip with air transfer from the air gap as the tip compresses during a stroke of the percussion massager as the tip encounters tissue of the user. As shown in FIG. 1*c*, the stroke has not closed the air gap 10 and thus there is no compression yet. Whereas in FIG. 1*d* the air gap narrows and in FIG. 1*e* there is essentially no gap. In FIG. 1*c*, a flexible rubber tip 5A in a normal (or resting) state includes an air gap of approximately 4 mm and a dome peak to flat (horizontal) plane measurement of 6.53 mm. Next, during a percussion stroke, as the dome peak of the rubber tip contacts the tissue of the user, the air gap narrows to 2 mm and the dome peak to flat (horizontal) plane measurement reduces to 2.42 mm (FIG. 1*d*). Finally, at the point of full stroke, the air gap goes to 0 and the dome peak to flat (horizontal) plane measurement reduces to 0.79 mm (FIG. 1*e*). Air from the air gap may be released during the stroke through one or more channels in the core 14 and out of the tool via one or more vents in the piston 16.

Percussion massager attachment tip system of FIGS. 1*c*, 1*d*, 1*e* show more controlled impact and reverberation. The tips' shape and geometry of the inner cavity is engineered to absorb impact and transfer gas while the lower aspect is designed to partially encapsulate the shaft creating a seal. Furthermore the tip is designed to create reverberation that generates secondary impact as the tip collapses and expands. The gap inside the head tip and the shaft could vary, adding differences in space inside that change reverberation distance. The creation of the space inside the tip allows the tip to collapse and expand, conforming to the tissue of the user and generating a secondary impact. The shaft has one or more channels which allow the tip to discharge gas through the shaft to the piston. The piston has one or more vents to allow air to discharge. Piston encapsulates the shaft and attaches via the elastomeric joint.

On skilled in the art appreciates that in accordance with the teachings herein, the air gap size and shape, dome material (e.g., rubber or elastomeric) and shape, the shaft channels and number of piston vents can all be varied to vary the overall impact experience to the user. In this first low impact configuration, the features of the tool and tip are set and static, i.e., there is no ability for a user to change one or more features of the tool out of the box.

Figure 12A:
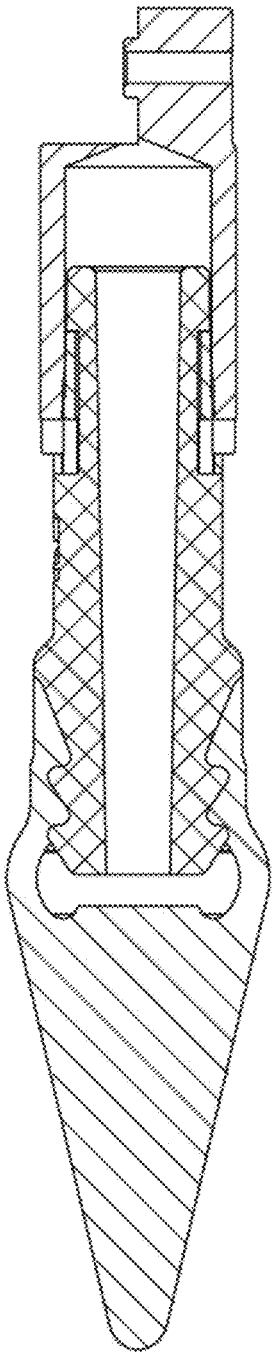
FIGS. 12*a*, 12*b*, 12*c* and 12*d* illustrate different tool configurations with a cone tip.
Figure 12B:
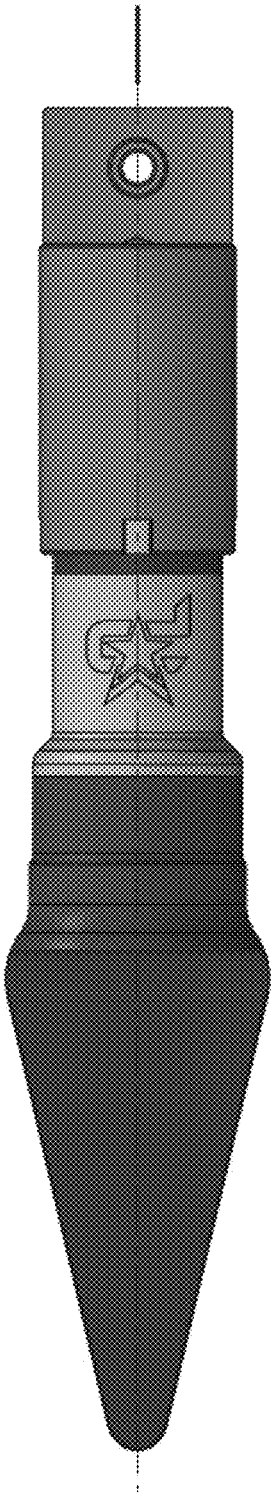
Figure 13A:
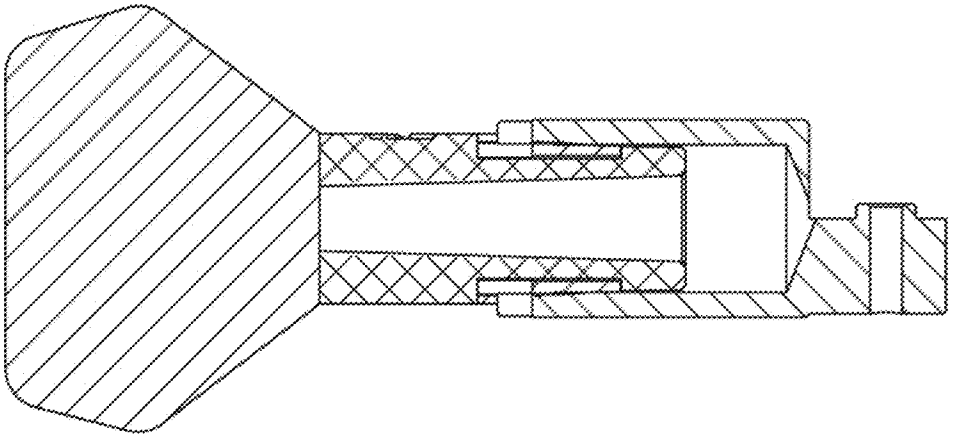
FIGS. 13*a*, 13*b*, 13*c* and 13*d* illustrate different tool configurations with a paddle tip.
Figure 13B:
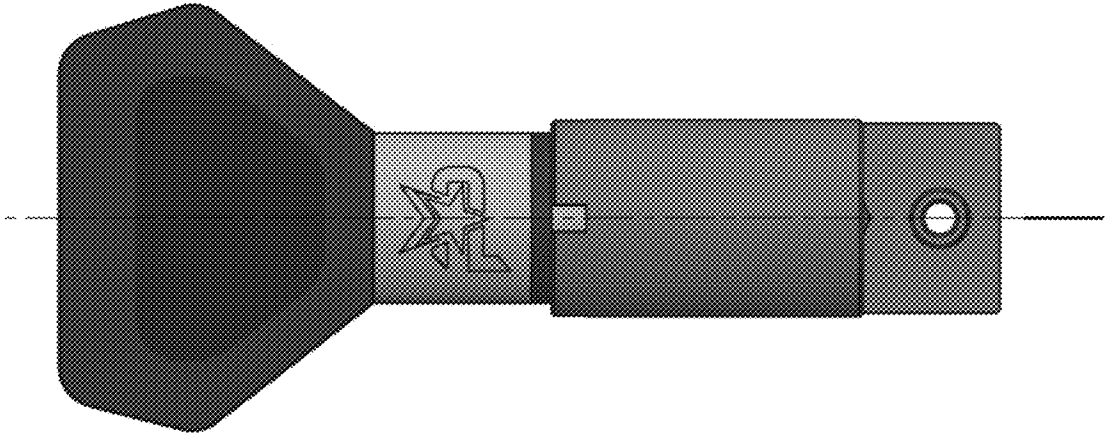

For a user seeking a higher impact level, a different tip could be selected to replace tip 5A on tool shaft 25. Other tips with differing shapes and/or durometer values can be selected to replace tip 5A and with the same internal geometry of the tool will result in a higher (or lower) impact level (see, for example, the tips described in commonly owned U.S. patent application Ser. No. 17/508,954 which is incorporated herein by reference in its entirety). The cone and paddle tips shown in FIGS. 12*a*, 12*b* (cone) and FIGS. 13*a*, 13*b* (paddle) with the tool configuration described above with respect to FIGS. 1*c*, 1*d*, 1*e* provide for additional examples.

Figure 2A:
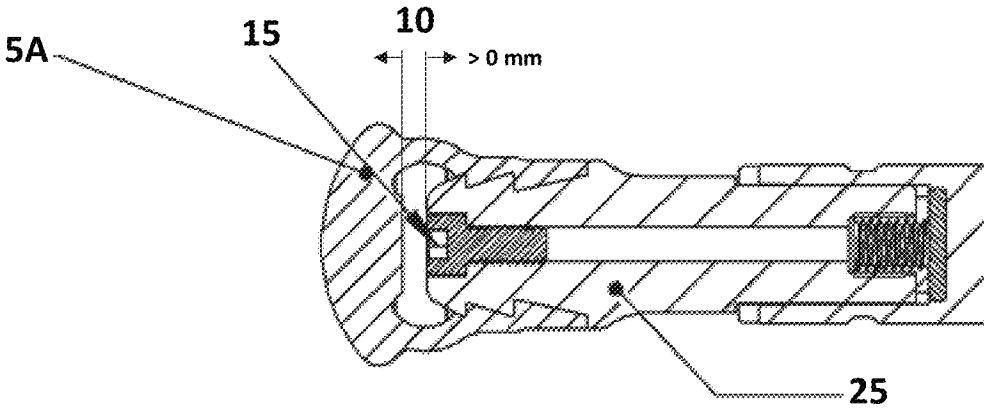
FIGS. 2*a* and 2*b* illustrate a second low impact tool configuration in accordance with a first embodiment described herein.
Figure 2B:
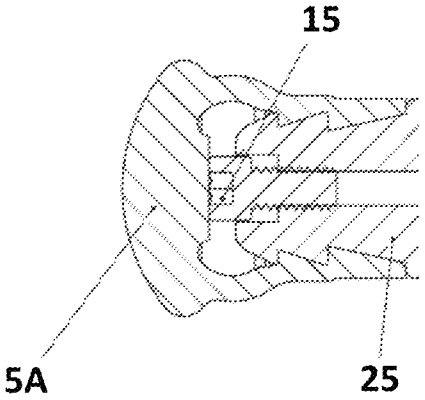

In a second low impact tool configuration shown in FIGS. 2*a* and 2*b*, the user is able to increase the impact level by narrowing the air gap 10 using screw 15. In this configuration, all other features of the tool such as tip shape and durometer value are the same, but by decreasing the air gap 10, less impact is absorbed by the tool, resulting in more impact being felt by the user.

Figure 3A:
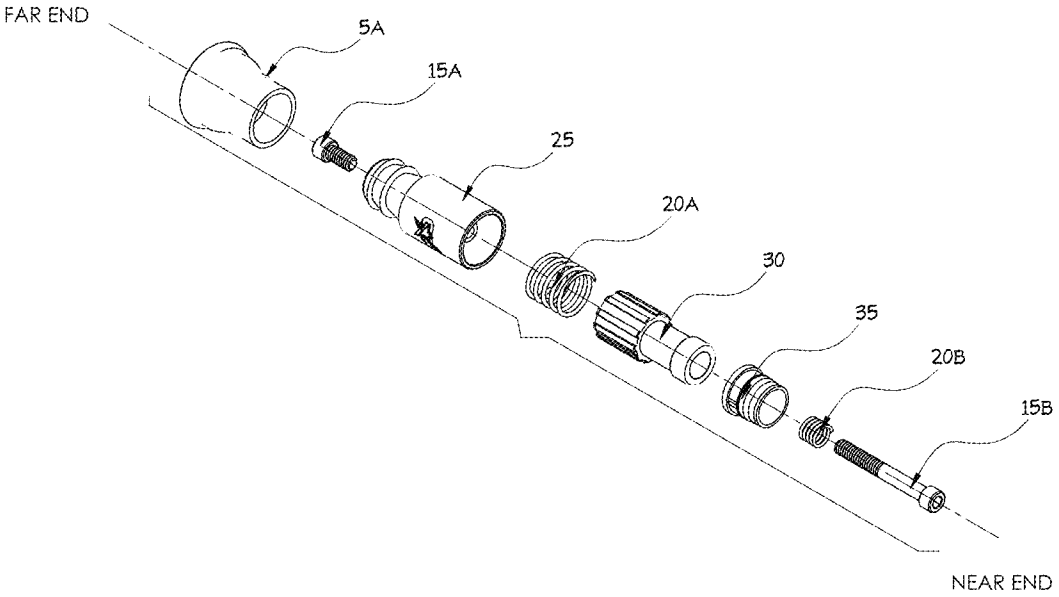
FIGS. 3*a*, 3*b* and 3*c* illustrate a third low impact tool configuration in accordance with a first embodiment described herein.
Figure 3B:
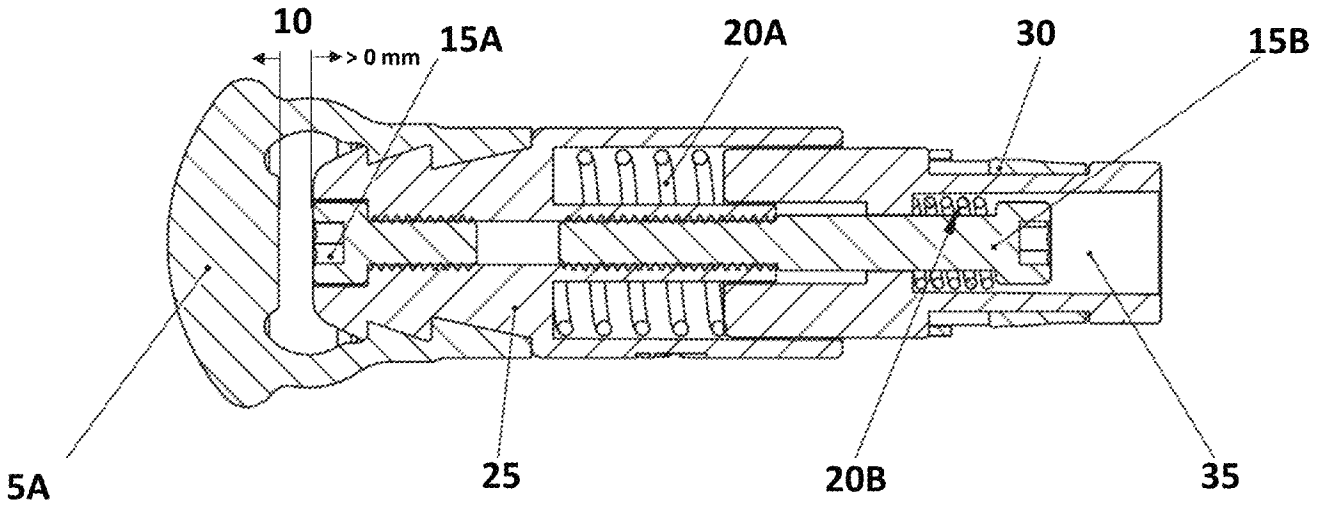
Figure 3C:
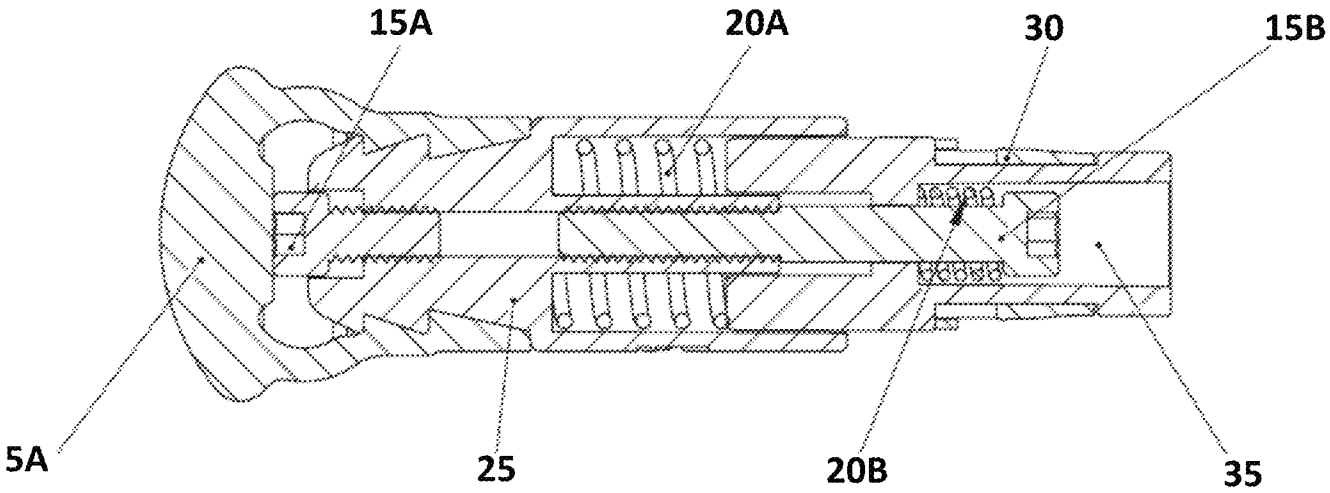

In yet a third low impact tool configuration, an additional impact selection mechanism is included which allows a user to adjust impact, in addition to changing the air gap 10 width. FIGS. 3*a*-3*c* illustrate a tool geometry which includes dual compression spring coils (springs) 20*a* and 20*b*, which can be adjusted between a fully open configuration (low impact, shown) and a compressed configuration (higher impact). Control screw 15*a* is used to adjust the air gap 10, while control screw 15*b* is used to compress/open the springs 20*a* and 20*b*. As you squeeze a compression spring, it pushes back to return to its original length. Rate is the amount of force required for every inch of compression or, for metric springs, millimeter of compression. The higher the rate, the harder it is to compress the spring. Springs 20*a* and 20*b* handle higher loads than standard fastener-mount compression springs. Springs 20*a* and 20*b* are secured by inserting an adjustable fastener 15B through the hole at the base. Recommended springs are a polyester/rubber blend that is wear, oil, and fuel resistant.

The internal geometry of the part directly controls the spring and the deformation of the rubber head to achieve specific results during a massage session. We obtain an s-curve when representing this deformation combined with forces through time.

Figure 3E:
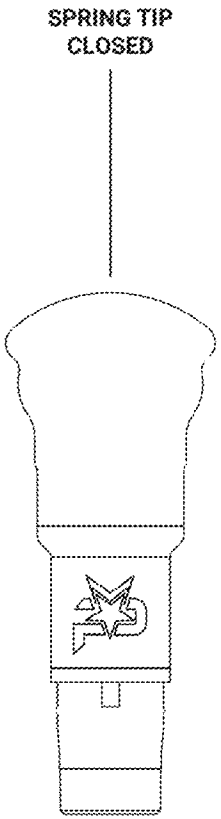
FIGS. 3*d* and 3*e* illustrate the third low impact tool configuration in a first open spring state (FIG. 3*b*) and a second closed spring state (FIG. 3*c*)
Figure 3D:
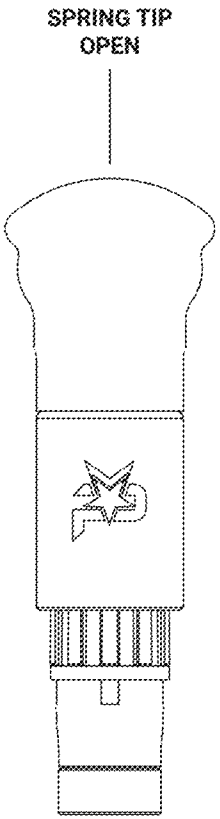

FIGS. 3*d* and 3*e* illustrate the third low impact tool configuration in a first open spring state (FIG. 3*d*) and a second closed spring state (FIG. 3*e*). Impact force will be higher when the percussion massager is operating with the tool in the closed spring state.

One skilled in the art will appreciate that when the tip deformation distance changes, the force required changes too. The larger the deformation desired, the larger the required applied force. The nominal case described above was calculated based on 5 mm deformation. To establish a comparison, to deform the rubber tip 5A in the first low impact tool configuration to 7 mm, the force required is 20.84 Joules. This result is not a constant. The main deformation factors in the low level configurations discussed herein are the internal geometry, the mass, tip shape, tip material (durometer level) and the speed.

Figure 4A:
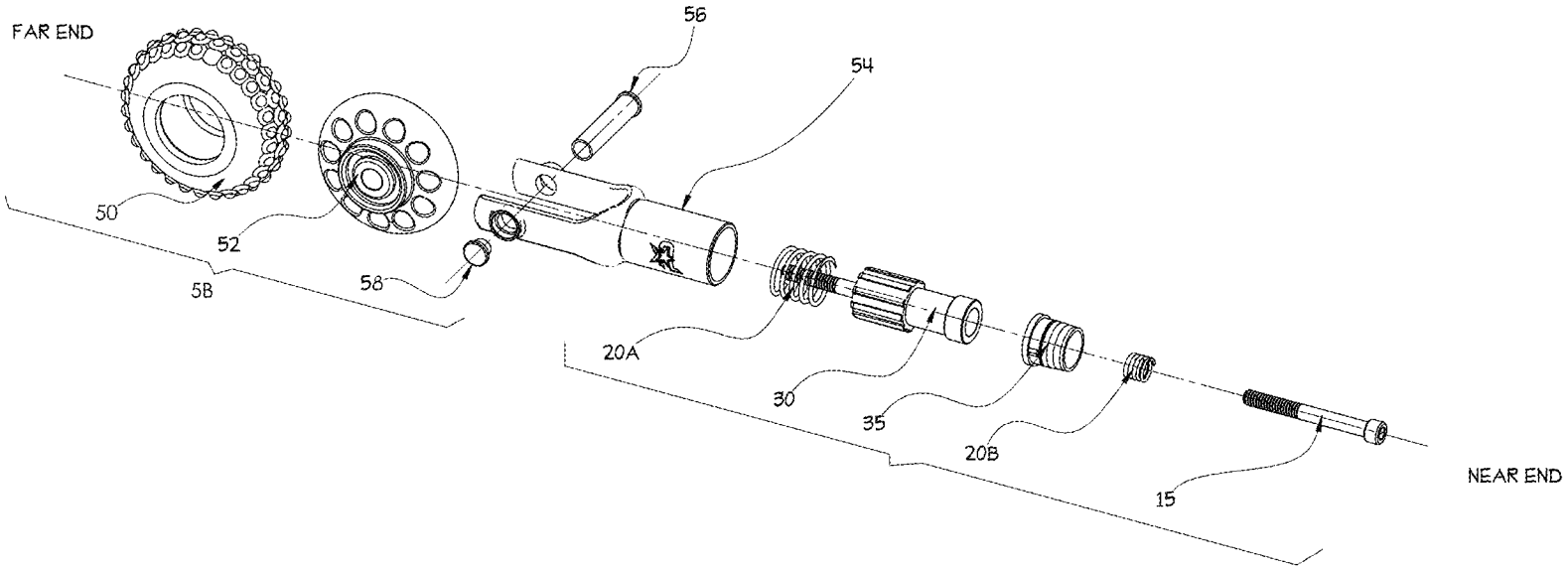
FIGS. 4*a*, 4*b* and 4*c* illustrate a third low impact tool configuration having a roller tip in accordance with a first embodiment described herein.
Figure 4B:
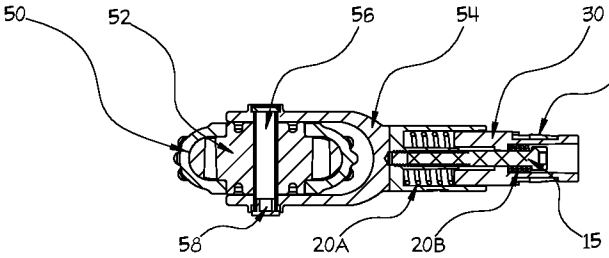
Figure 4C:
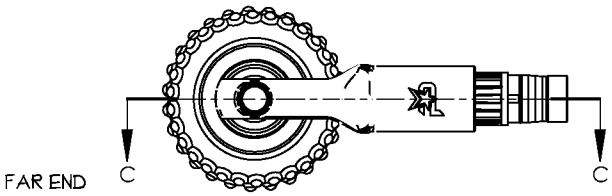
Figure 4E:
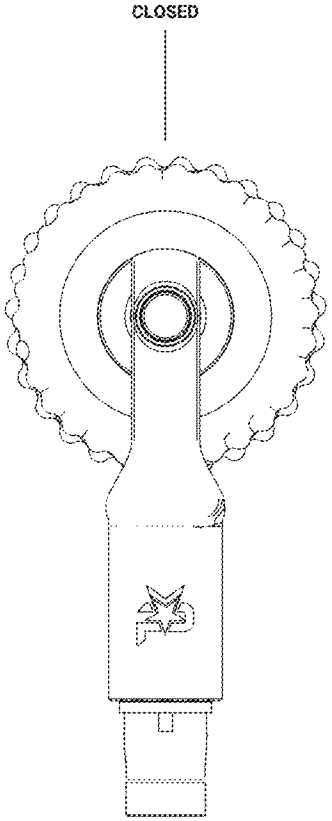
FIGS. 4*d* and 4*e* illustrate the third low impact tool configuration having a roller tip in a first open spring state (FIG. 4*b*) and a second closed spring state (FIG. 4*c*)
Figure 4D:
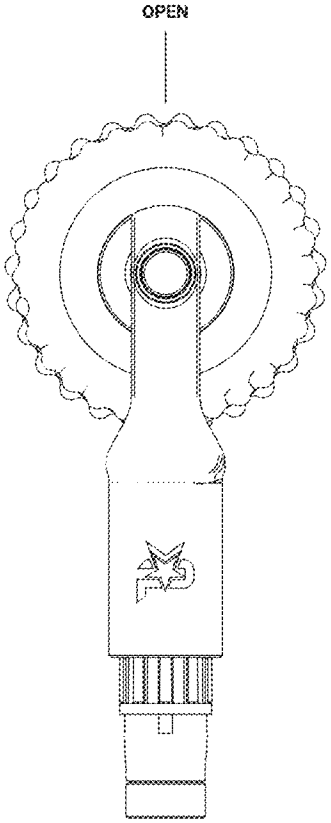

Additionally, one or more exemplary tips, including the roller tips described in commonly owned U.S. patent application Ser. No. 17/508,954 which is incorporated herein by reference in its entirety may be used in conjunction with a tool having the spring internal geometry described herein. Referring to FIGS. 4*a*, 4*b* and 4*c*, and exemplary roller tip 5B includes a wheel tire 50, wheel reem 52, strut 54, cup 56, axis elbow 58, spring seat 30, o-ring seal 35, along with dual compression spring coils (springs) 20*a* and 20*b*, which can be adjusted between a fully open configuration (low impact) and a compressed configuration (higher impact). Control screw 15 is used to compress/open the springs 20*a* and 20*b*. As you squeeze a compression spring, it pushes back to return to its original length. Rate is the amount of force required for every inch of compression or, for metric springs, millimeter of compression. The higher the rate, the harder it is to compress the spring. Springs 20*a* and 20*b* handle higher loads than standard fastener-mount compression springs. Springs 20*a* and 20*b* are secured by inserting an adjustable fastener 15B through the hole at the base. FIGS. 4*d* and 4*e* illustrate the third low impact tool configuration with roller tip 5B in a first open spring state (FIG. 4*d*) and a second closed spring state (FIG. 4*e*).

Figure 12D:
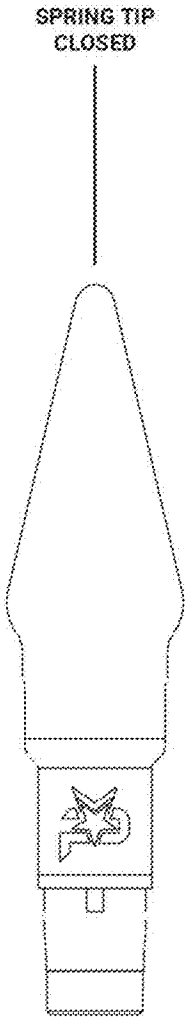
Figure 12C:
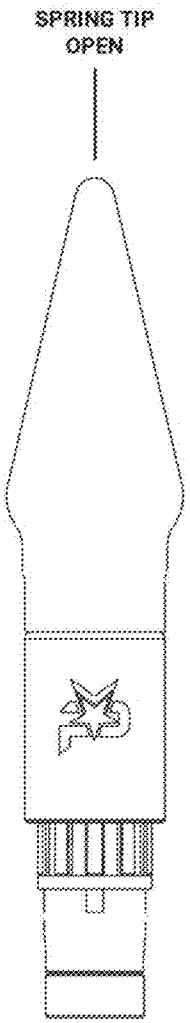
Figure 13D:
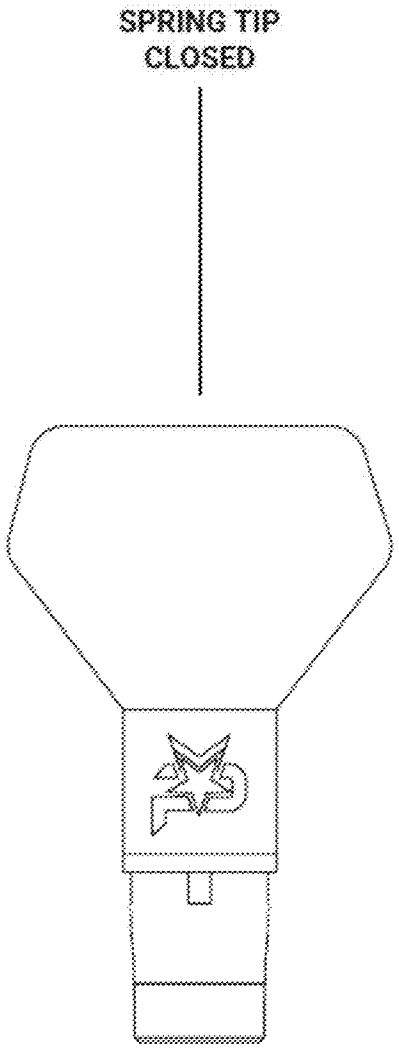
Figure 13C:
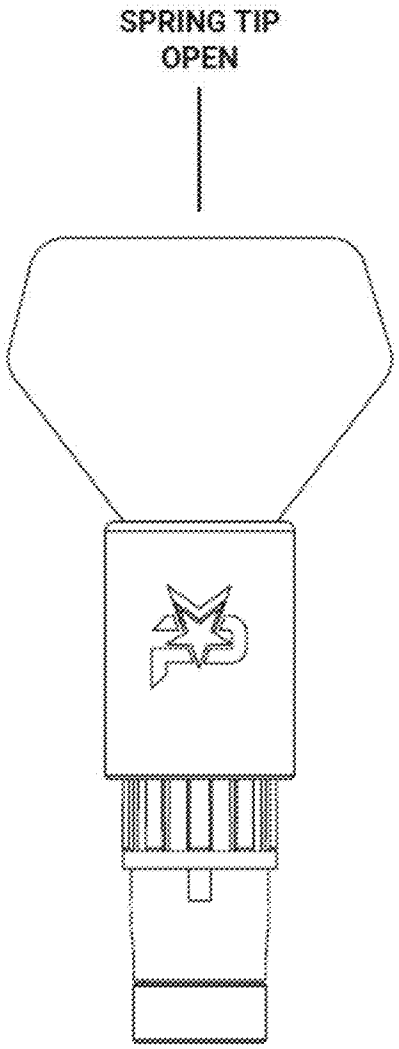

Additionally, the tool having the spring internal geometry described above may also be used with the cone and paddle tips shown in FIGS. 12*c*, 12*d* (cone) and FIGS. 13*c*, 13*d* (paddle).

Figure 5A:
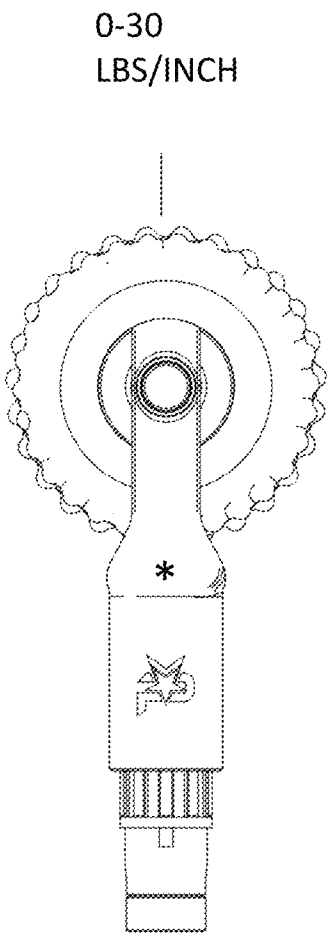
FIGS. 5*a*, 5*b*, 5*c*, 5*d* illustrate an exemplary tool set for use with a percussion massage device, wherein each individual tool is marked to identify impact range to the user.
Figure 5B:
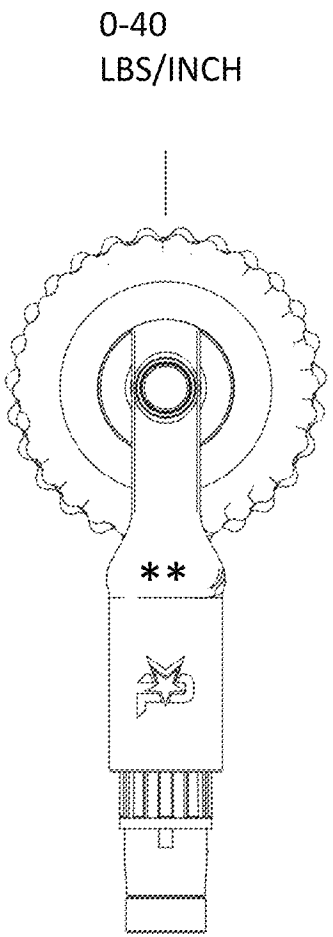
Figure 5C:
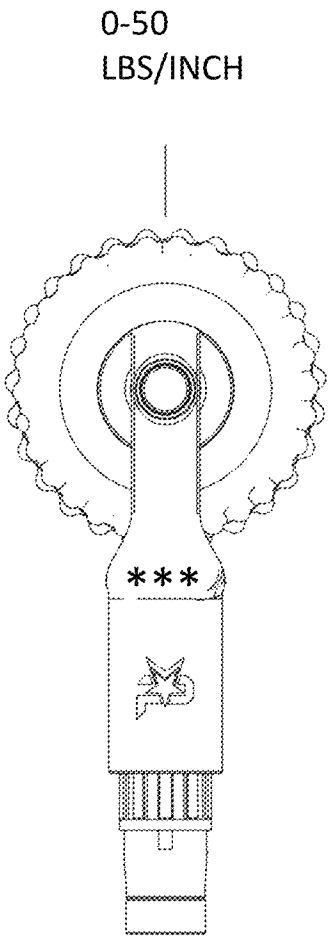
Figure 5D:
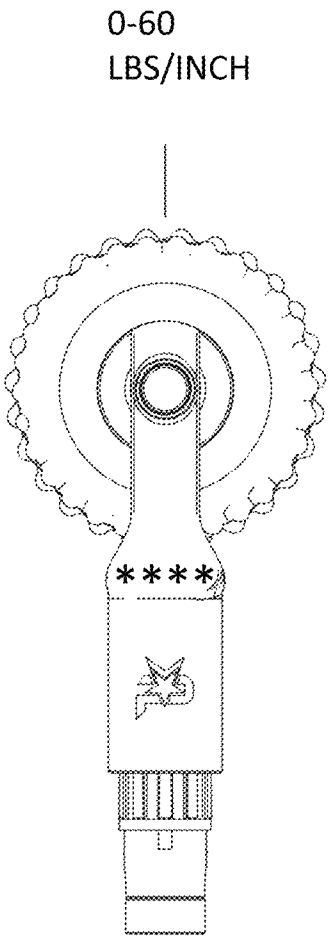

FIGS. 5*a*, 5*b*, 5*c* and 5*d* illustrate an exemplary tool set for use with a percussion massage device, wherein each individual tool is marked to identify impact range to the user. In the present example, stars represent impact level ranges available for each tool. In FIG. 5*a*, a single star (*) represents the tool providing the lowest level impact range for the set, e.g., 0-30 lbs/inch. In FIG. 5*b*, two stars () represent the tool providing the medium/low level impact range for the set, e.g., 0-40 lbs/inch. In FIG. 5***c*, three stars (*) represent the tool providing the medium/high level impact range for the set, e.g., 0-50 lbs/inch. And in FIG. 5***d*, a four stars (****) represent the tool providing the highest level impact range for the set, e.g., 0-60 lbs/inch. The changes in impact level range can be adjusted from tool to tool by, for example, using springs having different spring rates (K). One skilled in the art recognizes that the impact level indicators need not be limited to stars and could be colors, alphanumeric or other characters that would allow a user to easily distinguish the tools. Further, for embodiments herein where there is a single tool with multiple selectable tips having different impact level ranges, the tips will include the indicator for ease of selection.

B. Medium/Low Level Impact

In a second embodiment, an exemplary tool head for use with a percussion massager is intended to provide a user with a medium/low impact level experience, or levels, as compared to other tool head configurations in a set of tool heads. Impact level can vary based on a number of factors including tool configuration, tip shape and material, as well as user selectable changes to the tool configuration as will be discussed herein. Use of the terms low, medium and high herein are relative.

Figure 6A:
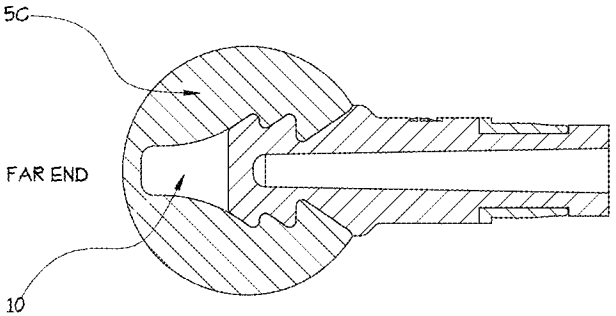
FIGS. 6*a* and 6*b* illustrate a first low impact tool configuration in accordance with a first embodiment described herein having an alternative tool tip.
Figure 6B:
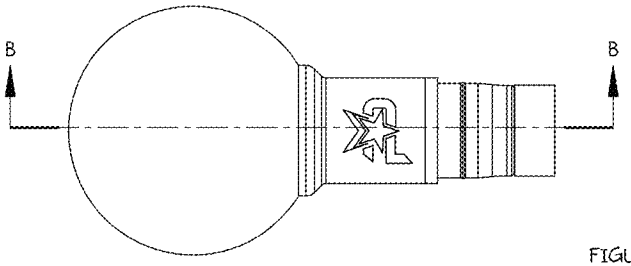

Referring to FIGS. 6*a* and 6*b*, the tip 5B of durometer value 60 as shown will deform 5 mm with an impact force of 16.74 Joules. By way of comparison, to deform tip 5B 7 mm, the force required is 73 Joules. Similar to the first low impact tool configuration of the first embodiment discussed above, this tool of FIGS. 6*a* and 6*b* is static, in that there are no adjustable features. But one skilled in the art will recognize that the variations introduced above with respect internal geometries of the second and third low impact tool configurations may also be applied hereto, by simply replacing tip 5A with tip 5B, thus providing a user with additional levels of impact to customize their massage experience.

C. Medium High Level Impact

In a third embodiment, an exemplary tool head for use with a percussion massager is intended to provide a user with a medium/high impact level experience, or levels, as compared to other tool head configurations in a set of tool heads. Impact level can vary based on a number of factors including tool configuration, tip shape and material, as well as user selectable changes to the tool configuration as will be discussed herein. Use of the terms low, medium and high herein are relative.

Figure 7A:
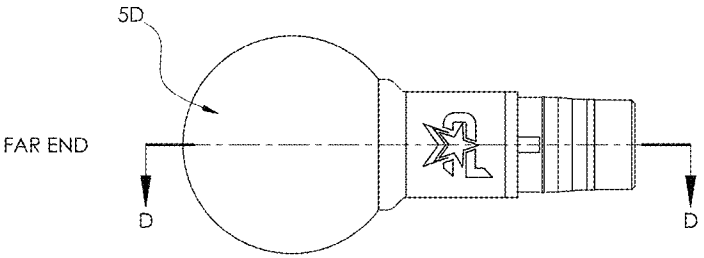
FIGS. 7*a* and 7*b* illustrate a third embodiment tool head wherein a first low impact tool configuration in accordance with a first embodiment described herein has an alternative tool tip.
Figure 7B:
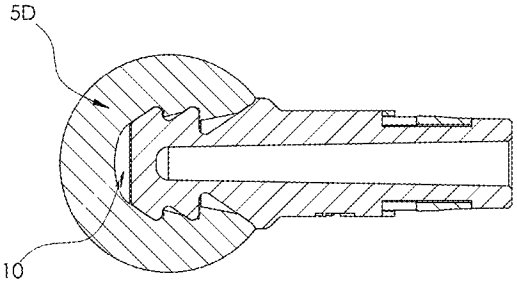

Referring to FIGS. 7*a* and 7*b*, the tip 5C of durometer value 60 as shown will deform 5 mm with an impact force of 31.12 Joules. By way of comparison, to deform tip 5C 7 mm, the force required is 62.5 Joules. Similar to the first low impact tool configuration of the first embodiment discussed above, this tool of FIGS. 7*a* and 7*b* is static, in that there are no adjustable features. Note that in comparing the tip configuration between tip 5B and 5C, merely changing the size and shape of the internal air chamber within the tip results in nearly doubling the required force to compress the tip 5 mm. But one skilled in the art will recognize that the variations introduced above with respect internal geometries of the second and third low impact tool configurations may also be applied hereto, by simply replacing tip 5A with tip 5C, thus providing a user with additional levels of impact to customize their massage experience.

D. High Level Impact

In a fourth embodiment, an exemplary tool head for use with a percussion massager is intended to provide a user with a high impact level experience, or levels, as compared to other tool head configurations in a set of tool heads. Impact level can vary based on a number of factors including tool configuration, tip shape and material, as well as user selectable changes to the tool configuration as will be discussed herein. Use of the terms low, medium and high herein are relative.

Figure 8A:
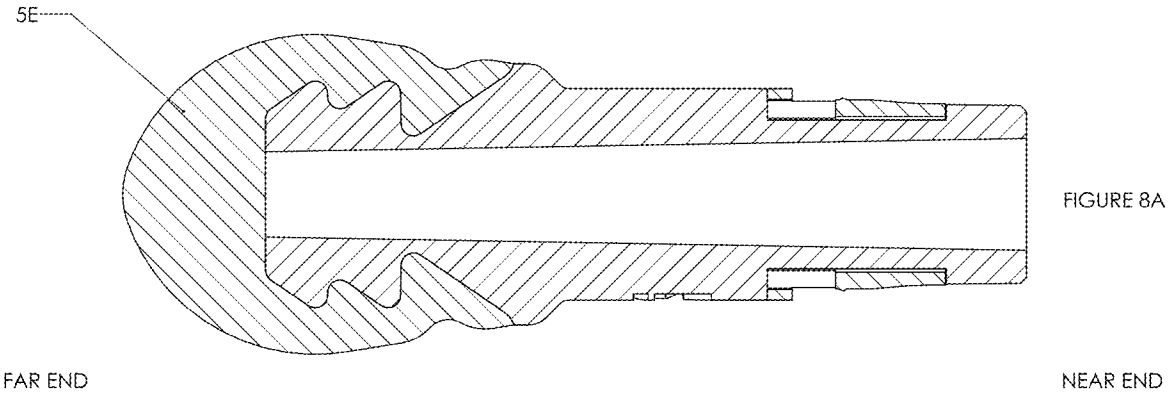
FIGS. 8*a* and 8*b* illustrate a fourth embodiment tool head wherein a first low impact tool configuration in accordance with a first embodiment described herein has an alternative tool head.
Figure 8B:
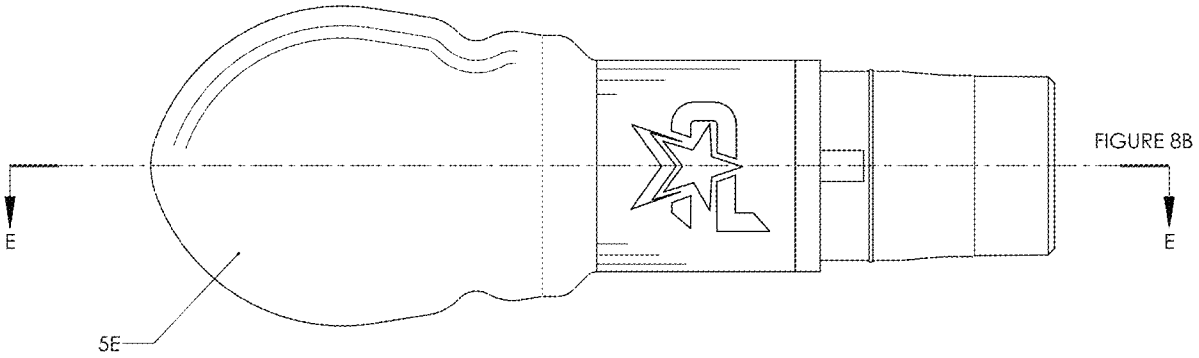
Figure 8C:
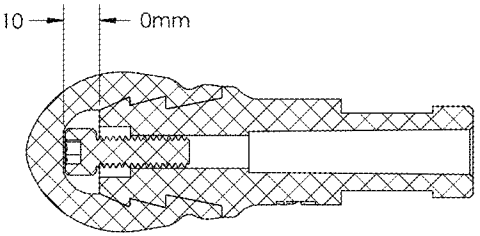
FIGS. 8*c*, 8*d* and 8*e* illustrate a fifth embodiment tool head wherein a second low impact tool configuration in accordance with a first embodiment described herein has the alternative tool head of FIGS. 8*a* and 8*b;*
Figure 8D:
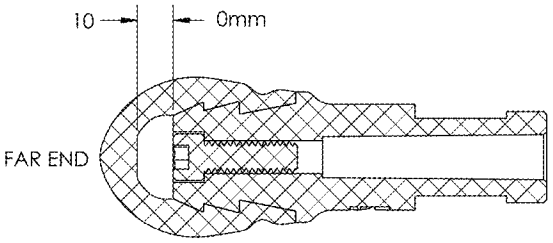
Figure 8E:
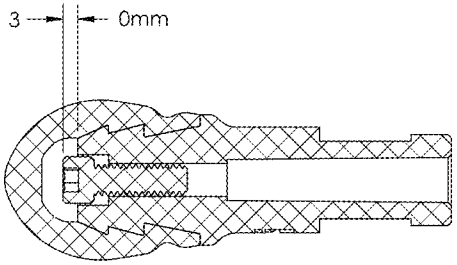

Referring to FIGS. 8*a* and 8*b*, the tip 5D of durometer value 60 as shown will deform 5 mm with an impact force of 127.26 Joules. By way of comparison, to deform tip 5D 7 mm, the force required is 224.99 Joules. Similar to the first low impact tool configuration of the first embodiment discussed above, this tool of FIGS. 8*a* and 8*b* is static, in that there are no adjustable features. But one skilled in the art will recognize that the variations introduced above with respect internal geometries of the second and third low impact tool configurations may also be applied hereto, by simply replacing tip 5A with tip 5D, thus providing a user with additional levels of impact to customize their massage experience. FIGS. 8*c*, 8*d* and 8*e* illustrate adjustable variations to the tool of FIGS. 8*a* and 8*b*, wherein impact can be adjusted by changing the width of an air gap 10 in the tip. In comparing these three configurations to one another, FIG. 8*c* with gap at 7 mm would be lowest impact, FIG. 8*d* with gap at 3 mm would be higher impact than FIG. 8*c* and FIG. 8*e* with essentially 0 mm gap would have highest impact.

Figure 9A:
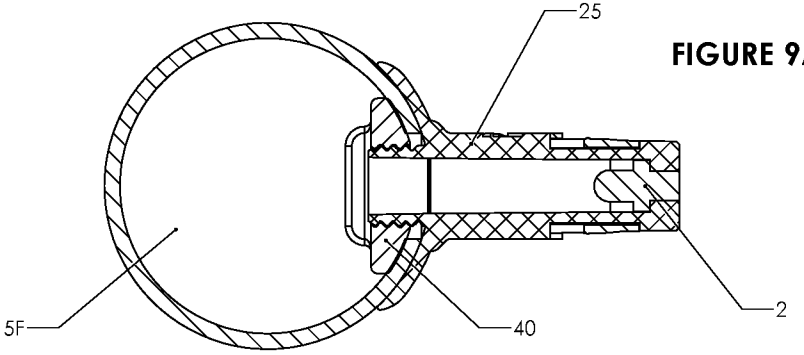
FIGS. 9*a*, 9*b* and 9*c* illustrate a fifth embodiment tool head wherein a tool head is inflatable.
Figure 9B:
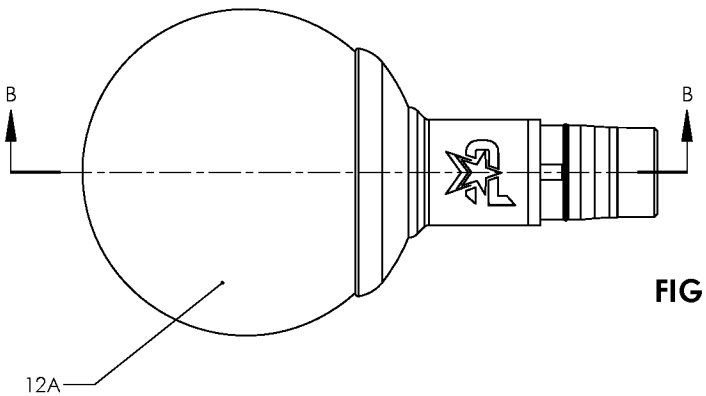
Figure 9C:
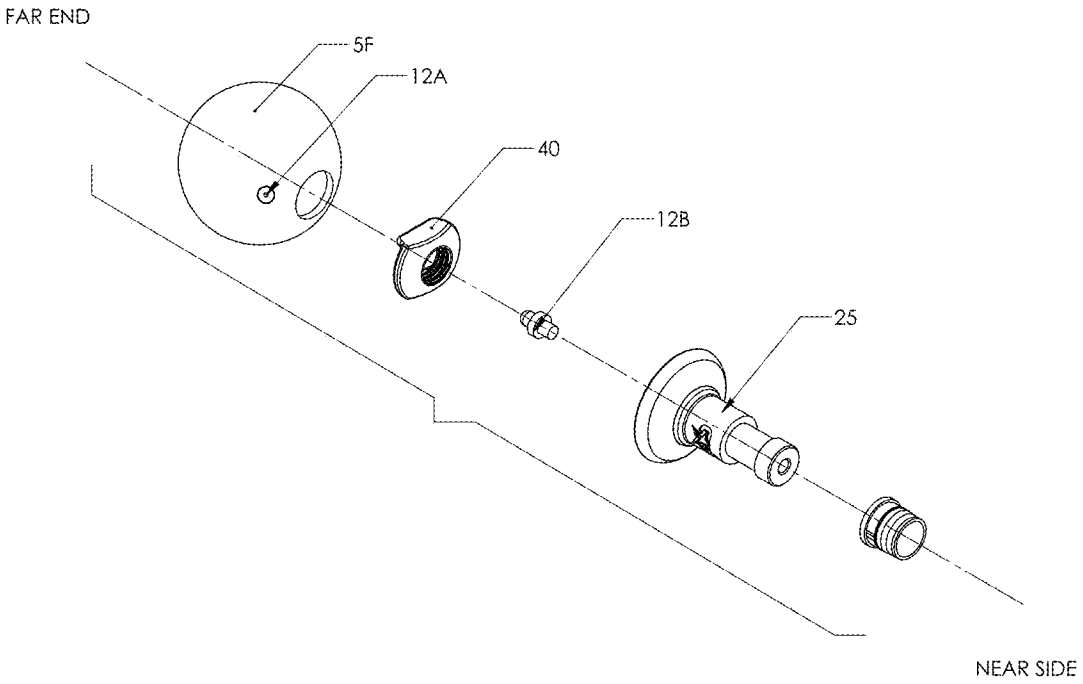
Figures 10A, 10B, 10C, 10D:
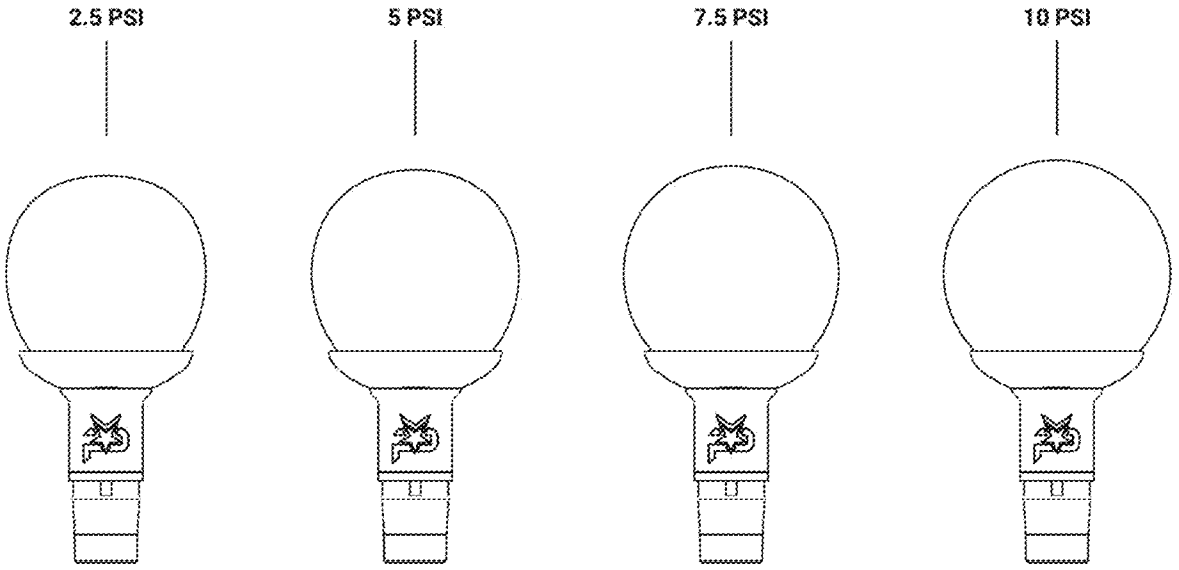
FIGS. 10*a*, 10*b*, 10*c* and 10*d* illustrate the tool head of the fifth embodiment at various PSI of inflation.

FIGS. 9*a*, 9*b*, and 9*c* illustrate yet another tool configuration which includes primary components of a shaft 25, nut 40, an inflatable/deflatable tip 5E and valves 12A and 12B. The inflatable/deflatable tip 5E can be inflated/deflated to achieve a predetermined PSI, which correlates with varying levels of impact force when used with a percussion massager. A user controls inflation and deflation of tip 5E through valves, 12A and 12B. The valves may be needle valves or other appropriate valves as would be recognized by one skilled in the art. In FIGS. 10*a*, 10*b*, 10*c* and 10*d*, the same tool is shown at different levels of inflation (PSI). One skilled in the art will appreciate that other tip configurations may be provided with the ability to inflate and deflate to adjust impact force during massaging. For example, one or more exemplary tips, including the roller tips described in commonly owned U.S. patent application Ser. No. 17/508,954 which is incorporated herein by reference in its entirety may include an inner tube or bladder which may be inflated.

Figure 11:
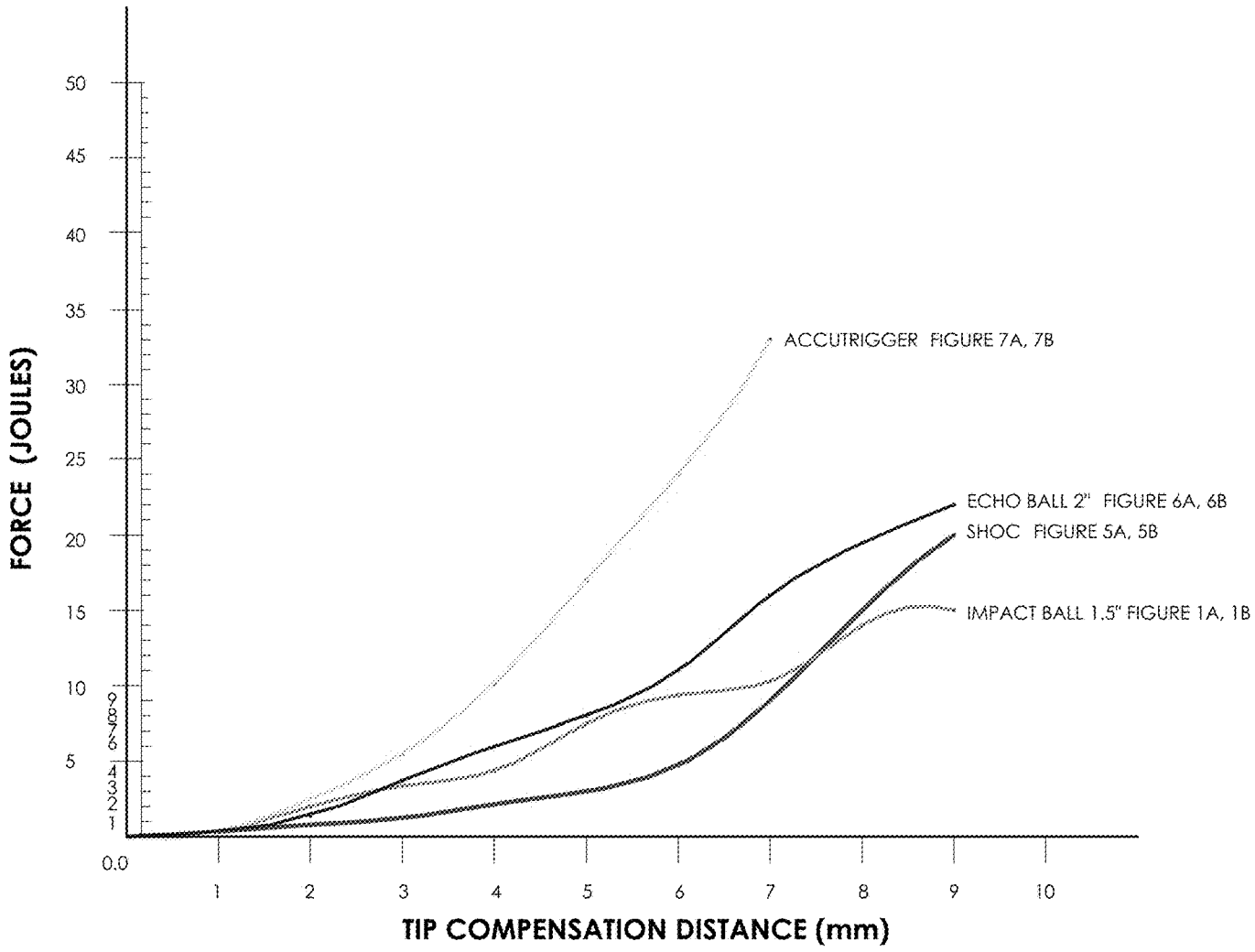
FIG. 11 is an exemplary graph illustrating impact force (Joules) required to achieve tool tip compression (mm) for different tip designs during use with a percussion massage device. wherein the tip durometer is the same across.

FIG. 11 is an exemplary graph illustrating impact force (Joules) required to achieve tool tip compression (mm) for different tip designs during use with a percussion massage device. In this graph, the only difference between the tested tools is the design of the tip. That is, the tool configuration itself is static and identical and the durometer of each tip is the same. The tip design alone produces the differences in required force illustrated in FIG. 11.

With respect to all embodiments described above, changing the rubber durometer or the attachment tip shape, e.g., dome, cone, spade shaped, paddle shaped, spherical, circular, etc., could expand the impact range that is available to a user. Further, multiple adjustment mechanisms may be included in a single tool configuration, i.e., a single configuration could include an inflatable tip as well as the spring mechanism discussed above with respect to the third low impact tool configuration described with respect to FIGS. 3*a*, 3*b* and 3*c*.

For those embodiments wherein multiple, exchangeable tips and/or tools are provided with the massager or otherwise available to the user (e.g., for individual purchase), the individual tips and/or tools may be marked by color, alphanumeric or other pictorial indicator which may be used to differentiate the anticipated level of impact force that a user might expect to receive from a particular tip and/or tool combination. For example, the color green may indicate low impact, the color yellow may indicate medium impact, the color orange may indicate medium/high impact and the color red may indicate high impact.

The following applications are incorporated herein by reference in their entireties: U.S. patent application Ser. No. 17/223,840 entitled Percussive Massager Rotational Accessory, filed Apr. 6, 2021; U.S. patent application Ser. No. 17/229,860 entitled Variable Stroke Percussive Massage Device, filed Apr. 13, 2021; U.S. patent application Ser. No. 17/508,954 entitled Constrained and Repositionable Percussive Massage Device Tool and Tool Receiver, filed Oct. 22, 2021; and U.S. patent application Ser. No. 17/524,732 entitled Percussion Massager Having Variable and Selectable Stroke Length filed Nov. 11, 2021, each of which is commonly owned and list overlapping inventors.

The tools, tips and attachment systems for a percussive massager device described herein may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect. Also, it is to be understood that the phraseology and terminology employed herein are for the purpose of the description and should not be regarded as limiting.

We claim:

1. A percussion massager attachment tool comprising:

an enclosure including a reciprocating piston; and a removable and hollow shaft;

a first flexible tip having an outer dome shape securely, but removably, connected to a first end of the removable and hollow shaft, wherein when secured to the first end of the removable and hollow shaft, a first inner geometry of the flexible tip forms an air gap having a first height, $H_1$, between an inside of the flexible tip and the first end of the removable and hollow shaft when a second end of the removable and hollow shaft is secured to the enclosure and the reciprocating piston is in a first state of operation; and further wherein when the reciprocating piston is in a second state of operation the air gap has a second height, $H_2$, resulting from flexure of the first flexible tip, where $H_2<H_1$ and air is transferred from the air gap through the removable and hollow shaft and is discharged from the percussion massager attachment tool via one or more channels in the removable and hollow shaft capable of discharging air at a second end of the enclosure, the percussion massager attachment tool with the first flexible tip providing a first impact force range.

2. The percussion massager attachment tool of claim 1, wherein the flexible tip is formed of rubber or an elastomeric material.

3. The percussion massager attachment tool of claim 1, wherein when the reciprocating piston is in a third state of operation the air gap has a third height, $H_3=0$ and air is transferred from the air gap through the removable and hollow shaft and is discharged from the percussion massager attachment tool via one or more vents at a second end of the enclosure.

4. The percussion massager attachment tool of claim 1, wherein the outer dome shape of the flexible tip flattens during the second and third states of operation responsive to impacting tissue of a user.

5. The percussion massager attachment tool of claim 1, wherein the first flexible tip is removable and replaceable.

6. The percussion massager attachment tool of claim 5, wherein a second flexible tip is secured to the first end of the removable and hollow shaft, the second flexible tip having a predetermined shape and a second inner geometry, and wherein the percussion massager attachment tool with the second flexible tip provides a second impact force range.

7. The percussion massage attachment tool of claim 6, wherein the first flexible tip has a first durometer value and second flexible tip is secured to the first end of the removable and hollow shaft, the second flexible tip having a same predetermined shape and a same first inner geometry as the first flexible tip, but the second flexible tip has a second durometer value wherein the percussion massager attachment tool with the second flexible tip provides a second impact force range.

8. The percussion massage attachment tool of claim 1, wherein the first flexible tip includes a transparent portion, wherein the air gap is visible during use of the percussion massage attachment tool.

9. A percussion massager attachment tool comprising:

an enclosure including a reciprocating piston;

a removable and hollow shaft;

a first flexible tip securely, but removably, connected to a first end of the removable and hollow shaft, wherein when secured to the first end of the removable and hollow shaft, the flexible tip forms an air gap having height H between an inner wall of the flexible tip and the first end of the removable and hollow shaft when a second end of the removable and hollow shaft is secured to the enclosure and the reciprocating piston is in a first state of operation, wherein air is transferred from the air gap through the removable and hollow shaft and is discharged from the percussion massager attachment tool via one or more channels in the removable and hollow shaft capable of discharging air at a second end of the enclosure; and further comprising an adjustable screw passing through the removable and hollow shaft, wherein a user can vary a space S between an end of the screw and the inner wall of the first flexible tip by turning the screw, wherein S can be adjusted from $0 \leq S \leq H$.

* * * * *